US007080918B2

(12) United States Patent
Rowland, Jr. et al.

(10) Patent No.: US 7,080,918 B2
(45) Date of Patent: Jul. 25, 2006

(54) LED ILLUMINATED FRAME

(75) Inventors: Elvis C. Rowland, Jr., Springfield, IL (US); Maurice L. Porter, Springfield, IL (US); Robert C. Henson, Springfield, IL (US)

(73) Assignee: Elvis C. Rowland, Jr. et al., Springfield, IL (US)

( * ) Notice: Subject to any disclaimer, the term of this patent is extended or adjusted under 35 U.S.C. 154(b) by 354 days.

(21) Appl. No.: 10/293,443

(22) Filed: Nov. 13, 2002

(65) Prior Publication Data

US 2004/0090771 A1 May 13, 2004

(51) Int. Cl.
*A47F 11/10* (2006.01)

(52) U.S. Cl. ..... 362/125; 362/30; 40/714; 40/204

(58) Field of Classification Search ..... 362/23, 362/28, 29, 30, 551, 555, 559, 560, 125, 362/135, 136, 137, 157, 217, 223, 362, 367, 362/374, 375; 40/204, 205, 206, 427, 541, 40/546, 549, 564, 573, 574, 575, 716, 732, 40/124.01, 124.02, 714
See application file for complete search history.

(56) References Cited

U.S. PATENT DOCUMENTS

| | | | | |
|---|---|---|---|---|
| 1,229,044 A | | 6/1917 | Davis | |
| 2,677,909 A | * | 5/1954 | Heydenryk | 40/714 |
| 3,318,032 A | * | 5/1967 | Robison et al. | 40/714 |
| 4,211,955 A | * | 7/1980 | Ray | 315/53 |
| 4,748,756 A | * | 6/1988 | Ross | 40/715 |
| 4,819,353 A | | 4/1989 | Glucksman et al. | |
| 4,831,754 A | | 5/1989 | Tallent | |
| 4,831,755 A | * | 5/1989 | Rodriguez | 362/27 |
| 4,835,661 A | | 5/1989 | Fogelberg et al. | |
| 4,989,122 A | | 1/1991 | Allekotte et al. | |
| 5,118,171 A | | 6/1992 | Ortiz | |
| 5,313,724 A | * | 5/1994 | Warner | 362/223 |
| 5,440,458 A | | 8/1995 | Volk | |
| 5,555,654 A | * | 9/1996 | Hermann | 362/31 |
| 5,902,034 A | | 5/1999 | Santosuosso et al. | |
| 5,943,801 A | * | 8/1999 | Wilkinson | 40/564 |
| 6,430,858 B1 | | 8/2002 | Andre | |

OTHER PUBLICATIONS

Merriam-Webster's Collegiate Dictionary, 10th edition, Merriam-Webster, 1993 p. 813.*
The Oxford Amerrican Desk Dictionary, Oxford University Press, 1998 p. 418.*
The Photonics Dictionary, Laurin Publishing, 1996-2004 http://www.photonics.com/dictionary/lookup/XQ/ASP/url.lookup/entrynum.3586/letter.o/pu./QX/lookup.htm.*

* cited by examiner

*Primary Examiner*—Sandra O'Shea
*Assistant Examiner*—Ismael Negron

(57) ABSTRACT

An illuminated frame for displaying items, includes a first compartment, a second compartment, a divider, and an LED light source. The first compartment displays items. The second compartment houses the light source. The divider separates the first compartment from the second compartment, wherein the divider is made of a light impermeable material and has an aperture for allowing light to pass from the second compartment to the first compartment.

7 Claims, 4 Drawing Sheets

LED ILLUMINATED FRAME

BACKGROUND OF THE INVENTION

Frames for displaying pictures or objects are illuminated in many different fashions. Often these frames are illuminated by room light or external attached light fixtures. This practice results in undesirable lighting within the frame, however. Prior attempts to improve frame lighting have moved the light sources within the frame. Interior frame lighting presents difficulties in hiding the light source, distributing the light evenly, and power supply to the light source.

It is therefore a principal object of this invention to provide an illuminated frame where the light source is obscured from view.

A further object of this invention is to provide an illuminated frame where light is distributed evenly.

A still further object of this invention is to provide an illuminated frame where light is supplied by an LED.

These and other objects will be apparent to those skilled in the art.

BRIEF SUMMARY OF THE INVENTION

The present invention provides an illuminated frame for displaying items, including a first compartment, a second compartment, a divider, and an LED light source. The first compartment displays items. The second compartment houses the light source. The divider separates the first compartment from the second compartment, wherein the divider is made of a light impermeable material and has an aperture for allowing light to pass from the second compartment to the first compartment.

BRIEF DESCRIPTION OF THE DRAWINGS AND PHOTOS

DESCRIPTION OF THE PREFERRED EMBODIMENTS

Figure 1:
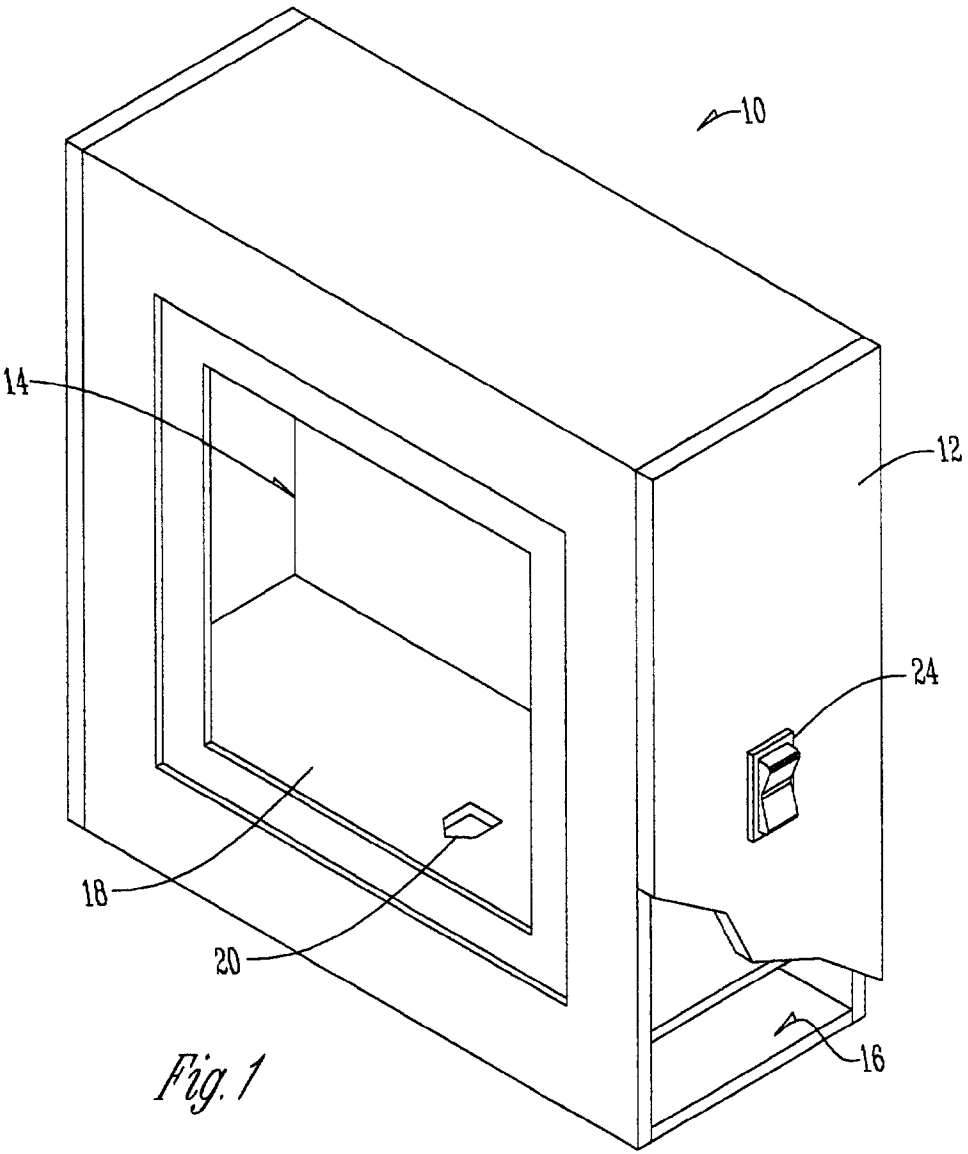
FIG. 1 is a partial sectional perspective view of the illuminated frame of the present invention.
Figure 2:
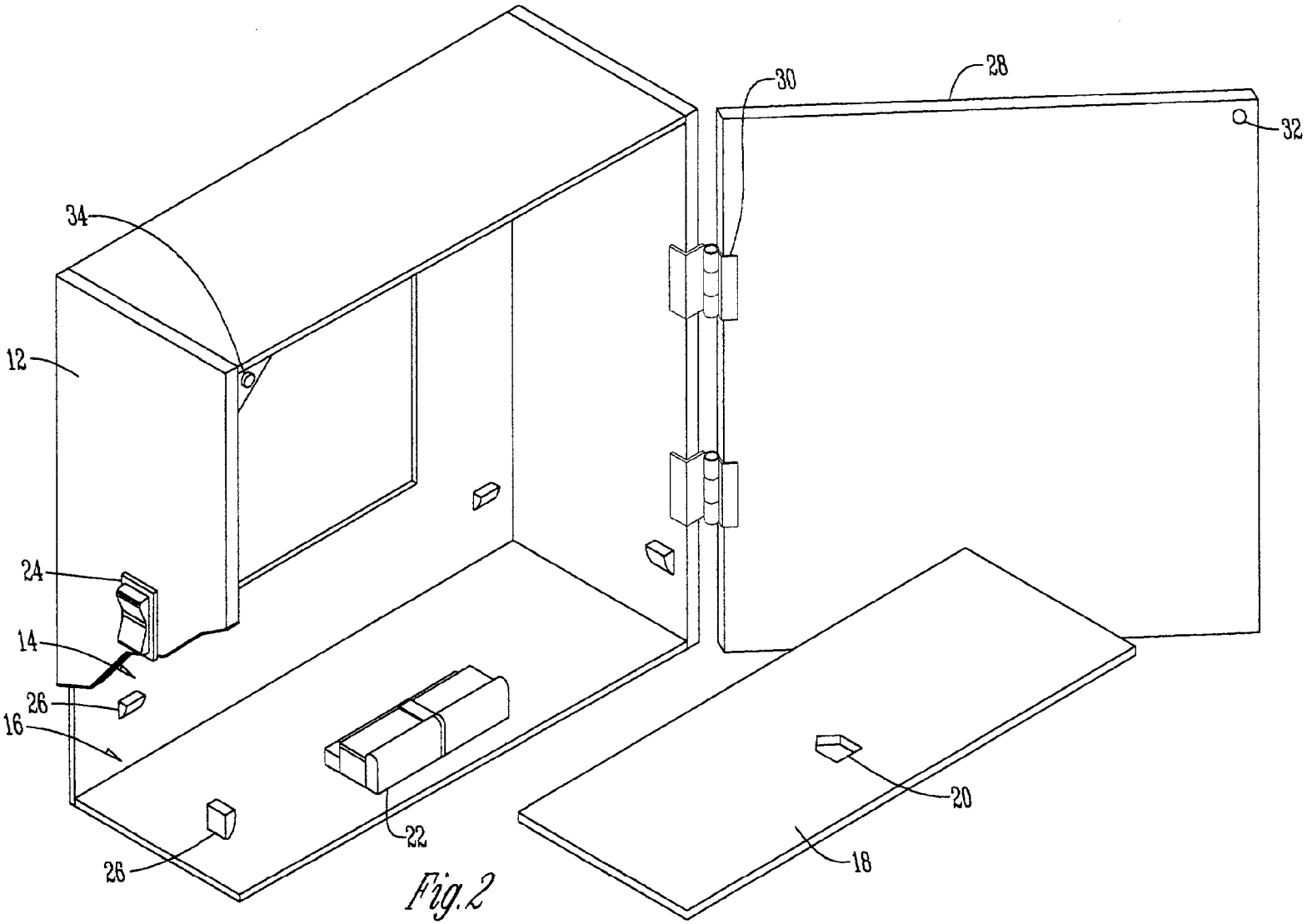
FIG. 2 is an exploded partial sectional perspective view of the illuminated frame of the present invention.

Referring to FIG. 1, an illuminated frame 10 of the present invention is shown. The illuminated frame 10 includes a frame 12 encircling a first compartment 14 for displaying items and a second compartment 16. The first and second compartments 14 and 16 are separated by a divider 18. The divider 18 is made of a light impermeable material and has an aperture 20 for allowing light to pass from the second compartment 16 into the first compartment 14 for illuminating objects displayed in the first compartment 14.

Referring to FIG. 1, the illuminated frame 10 includes a light source 22 contained in the second compartment 16. The light impermeable material of the divider 18 obscures view of the light source 22, while the aperture 20 allows light to pass into the first compartment 14. A switch 24 is attached to the frame 12 and connected in electric communication to the light source 22 to turn the light source 22 on and off.

Brackets 26 are attached to the frame 12 inside the second compartment 16. The brackets 26 support the divider 18 above the second compartment 16 and allow the divider 18 to be easily removed from the frame 12.

Door 28 is hingedly attached to the frame 12 via hinges 30. When closed, the door 28 seals one open end of the frame 12. The door 28 can be releasably sealed to the frame 12 via mated hook fastener 32 and loop fastener 34. The hook fasteners 32 are attached to the corners of door 28 and mate with loop fasteners 34 attached to corresponding corners on frame 12.

Figure 3:
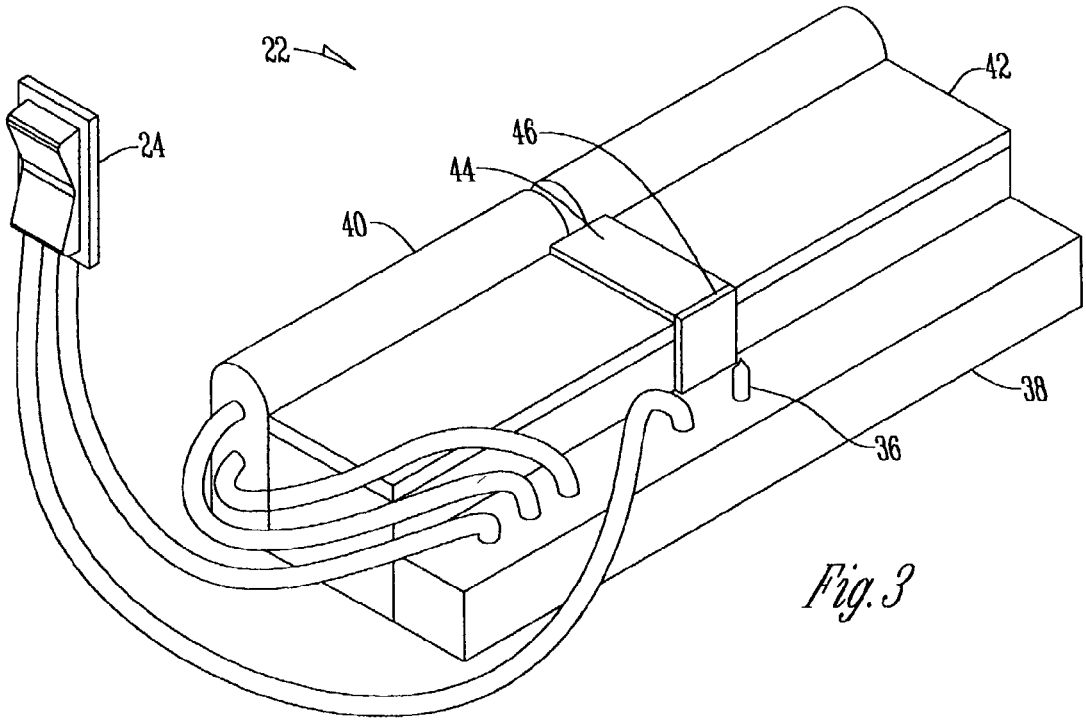
FIG. 3 is a perspective view of the light source of the present invention.

Referring to FIG. 3, the light source 22 includes an LED bulb 36 connected in electric communication with a breadboard 38. The breadboard is connected in electric communication with the switch 24 and a battery compartment 40. As described above, the switch 24 is connected in electric communication to the light source 22 to turn the LED 36 on and off. The battery compartment 40 acts as a power supply for the LED 36.

A center piece 42 is positioned between the breadboard 38 and the battery compartment 40. A first reflective surface 44 is positioned atop the center piece 42, and a second reflective surface 46 is positioned on the side of the center piece 42 that faces the breadboard 38. The first reflective surface 44 and the second reflective surface 46 are positioned directly beneath the aperture 20 and operate to diffuse light from the LED through the aperture 20 and into the first compartment 14.

Figure 4:
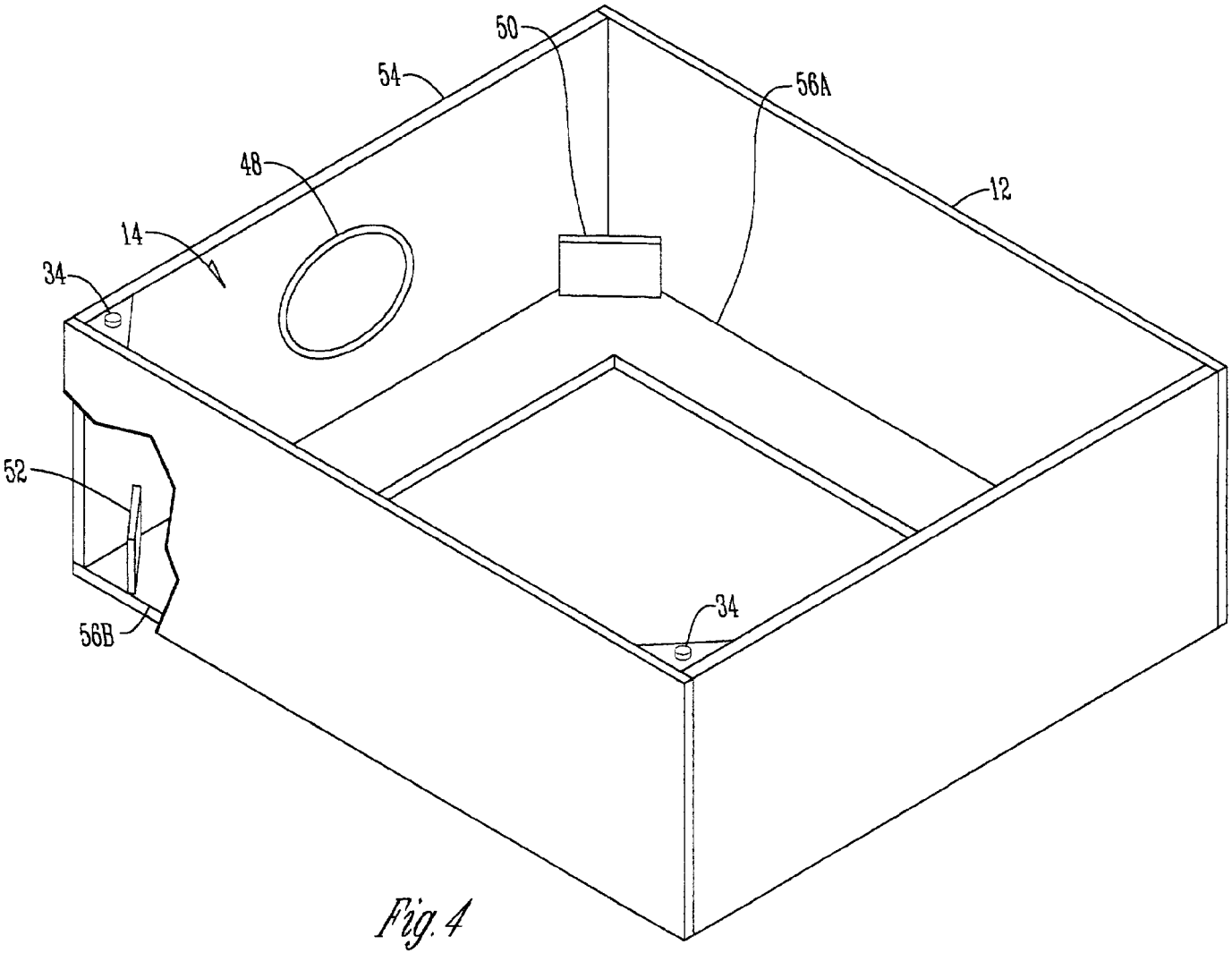
FIG. 4 is a perspective view of the illuminated frame of the present invention.

Referring to FIG. 4, the first compartment 14 includes third, fourth, and fifth reflective surfaces 48, 50 and 52. Reflective surfaces 48, 50 and 52 are positioned about the first compartment 14 to diffuse light from the LED 36 and illuminate objects placed in the illuminated box 10. The third reflective surface 48 is attached to the center of the frame 12 upper wall 54. The fourth reflective surface 50 is attached to the frame 12 corner 56A. Similarly, the fifth reflective surface 52 is attached to the frame 12 corner 56B.

Referring to FIGS. 1–4, in operation, light is emitted by the LED 36 and is diffused through the aperture 20 by the first and second reflective surfaces 44 and 46 respectively. The light is further diffused within the first compartment 14 by the third, fourth, and fifth reflective surfaces 48, 50 and 52. The effect is full illumination of objects contained in the first compartment 14.

It is therefore seen that the present invention provides an illuminated frame 10 where the light source 22 is obscured from view. It is also seen that the present invention provides an illuminated frame 10 where light is distributed evenly. It is further seen that the present invention provides an illuminated frame 10 where light is supplied by an LED 36.

It is therefore seen that this invention will accomplish at least all of its stated objectives.

What is claimed is:

1. An illuminated frame for displaying items, comprising:

a first compartment for displaying items;

a second compartment housing a light source;

a divider separating the first compartment from the second compartment, wherein the divider is made of a light impermeable material and has an aperture for allowing light to pass from the second compartment to the first compartment; and wherein the light impermeable material of the divider obscures view of the light source.

2. The apparatus of claim 1 wherein the light source has a battery power supply located in the second compartment.

3. The apparatus of claim 1 wherein a reflective surface is located within the second compartment to dispense light from the light source through the aperture and into the first compartment.

4. The apparatus of claim 1 wherein a first reflective surface is located within the first compartment to dispense light from the light source within the first compartment.

5. The apparatus of claim 4 wherein a second reflective surface is located within with the first compartment to dispense light from the light source within the first compartment, and wherein the second reflective surface is positioned to be free from physical contact with the first reflective surface.

6. An illuminated frame for displaying items, comprising:

a first compartment for displaying items;

a second compartment housing a light source; and a divider separating the first compartment from the second compartment, wherein the divider is made of a light impermeable material and has an aperture for allowing light to pass from the second compartment to the first compartment.

7. An illuminated frame for displaying items, comprising:

a first compartment for displaying items;

a second compartment housing a light source;

a divider separating the first compartment from the second compartment;

wherein the divider is made of a light impermeable material and has an aperture for allowing light to pass from the second compartment to the first compartment;

wherein the light impermeable material of the divider obscures view of the light source;

wherein the light source has a battery power supply located in the second compartment;

wherein a third reflective surface is located within the second compartment to dispense light from the light source through the aperture and into the first compartment;

wherein a first reflective surface is located within the first compartment to dispense light from the light source within the first compartment;

wherein a second reflective surface is located within the first compartment to dispense light from the light source within the first compartment, and wherein the second reflective surface is positioned to be free from physical contact with the first reflective surface; and wherein the light source is an LED.

* * * * *